US005724909A

United States Patent [19]

Pitman et al.

[11] Patent Number: 5,724,909

[45] Date of Patent: Mar. 10, 1998

[54] PASSIVE PATHWAY MARKING SYSTEM

[75] Inventors: Robert F. Pitman, San Jose; Daniel L. Garrison, Campbell, both of Calif.

[73] Assignee: Burke Industries, Inc., San Jose, Calif.

[21] Appl. No.: 804,026

[22] Filed: Feb. 19, 1997

[51] Int. Cl.[6] ..... G09F 13/20; F21K 2/00

[52] U.S. Cl. ..... 116/202; 40/542; 362/84

[58] Field of Search ..... 116/202, 205; 40/542, 543, 582, 583; 52/287.1, 288.1, 716.1, 716.6, 717.03, 718.01, 718.03, 718.06; 362/84, 146; 250/462.1, 463.1, 466.1

[56] References Cited

U.S. PATENT DOCUMENTS

| | | | |
|---|---|---|---|
| 355,810 | 1/1887 | Brown . | |
| 1,389,941 | 9/1921 | Erdle . | |
| 2,341,583 | 2/1944 | Tuve . | |
| 4,385,586 | 5/1983 | Schriever . | |
| 4,401,050 | 8/1983 | Britt et al. . | |
| 4,663,906 | 5/1987 | Weinar | 52/288.1 |
| 5,499,170 | 3/1996 | Gagne | 362/84 |
| 5,657,598 | 8/1997 | Wilbs et al. | 52/287.1 |

FOREIGN PATENT DOCUMENTS

| | | | |
|---|---|---|---|
| 346708 | 3/1937 | Italy | 40/542 |
| 406600 | 8/1966 | Switzerland | 52/288.1 |

OTHER PUBLICATIONS

Active Safety, Copy of Fire and Blackout Emergency Safety Systems brochure, 4 Pages (1992).

*Primary Examiner*—William A. Cuchlinski, Jr.
*Assistant Examiner*—Willie Morris Worth
*Attorney, Agent, or Firm*—James R. Cypher

[57] ABSTRACT

This invention relates to source of photoluminescence that attaches to a building structure, providing back-up lighting. A source of photoluminescence constructed in a accordance with the present invention consists of a base member which attaches to the building structure, a support member which releasably attaches to the base member, and photoluminescent material affixed to the support member so as to be visible to an occupant escaping from the building structure. The support member is formed with a cover member that in cooperation with the building structure hides the base member from view when the source of photoluminescence is attached to the building structure. The photoluminescent material is affixed to the outer surface of the cover member.

11 Claims, 6 Drawing Sheets

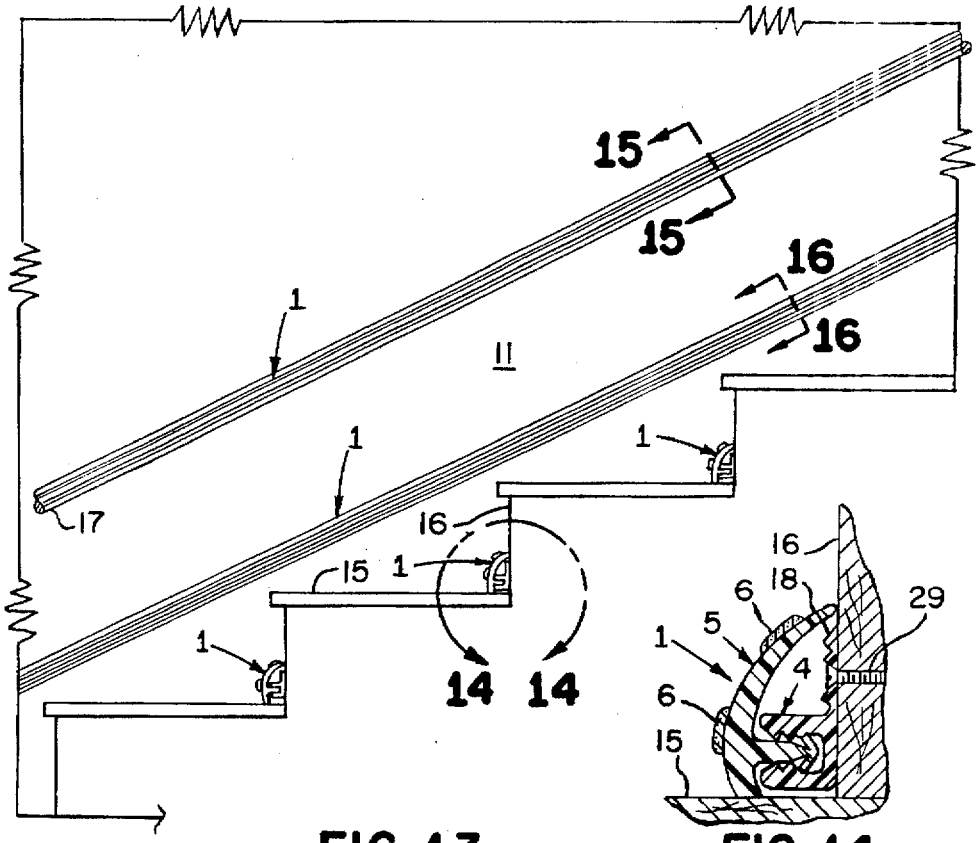
FIG. 13
FIG. 14
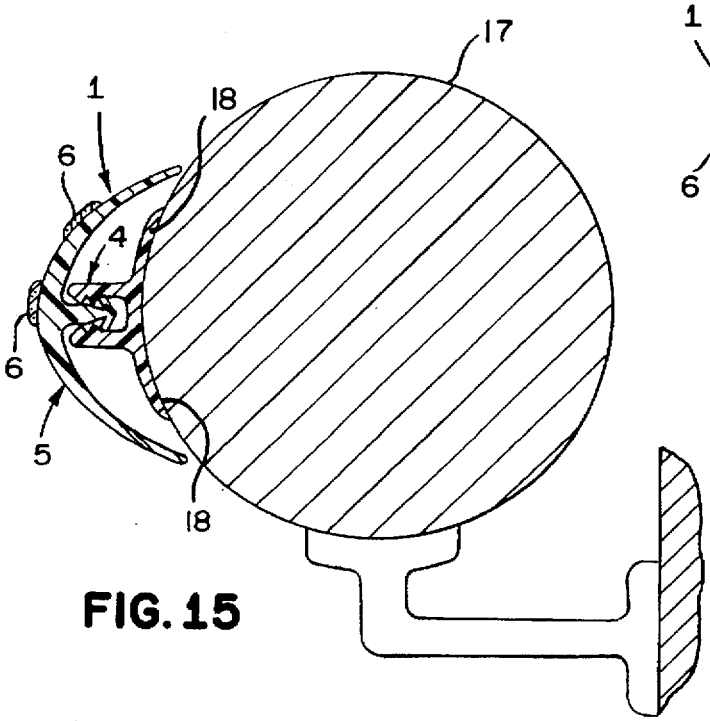
FIG. 15
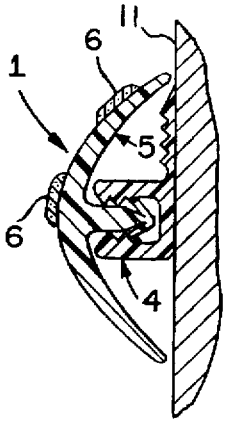
FIG. 16

PASSIVE PATHWAY MARKING SYSTEM

BACKGROUND OF THE INVENTION

This invention relates to source of photoluminescence that attaches to a building structure, providing back-up lighting. The source of photoluminescence consists of a base member which attaches to the building structure, a support member which releasably attaches to the base member, and photoluminescent material which is affixed to the support member.

Almost all commercial buildings in the United States are required to have back-up lighting systems or pathway marking systems, as they are also known. These systems help occupants to leave an unlit building when there has been a power failure caused by a fire, earthquake or some other unexpected event. Pathway marking systems are labeled as either "active" or "passive", depending on whether they require a power source.

Active systems generally consist of battery-powered light sources which are automatically activated by power failures. These systems perform well, provided the battery or batteries have been maintained or periodically replaced to insure they have sufficient power capacities.

Active systems are enhanced by the addition of passive systems. Passive systems are generally maintenance free since they do not require a power source to aid occupants in exiting the building. Furthermore passive systems work when the lights are off, whether there has been a power outage or not.

Typical passive pathway marking systems, including the present invention, utilize photoluminescent compounds that automatically "charge" themselves with the ambient light present in the building. During a power failure, or anytime when there is darkness, photoluminescent passive systems provide light as they discharge their stored energy. The intensity of the luminescence provided by photoluminescent compounds begins to decay as soon as the charging light source is removed, but since human vision improves with darkness, well designed passive systems can generate light detectable to the human eye for up to several hours.

In a passive system, the photo-luminsecent material can be any material capable of producing a sustained visible glow in darkness for an appreciable time after having been activated by a source of light. Examples of photoluminescent pigment include: zinc sulphide, calcium sulphide and strontium sulphide.

Photoluminescent systems are commonly used to demarcate the outlines and intersections of building structures, such as stair risers, wall to floor intersections, sloped ramps, doorways, aisles in stores, or the location of handrails. Illuminating exit paths on the wall just above the floor or at floor level is particularly important since the smoke from a fire will generally obscure sight higher up in the room, and because crawling below the smoke is often recommended as the safest means of escape.

A number of passive, photoluminescent pathway marking systems are taught by the prior art. Some of the existing products sold on the market extrude the photoluminescent compound into the building material itself. This is fine for new installation, but if used in retrofit, the new material must replace existing materials, which means the investment in the original materials is lost.

Other prior art references, such as U.S. Pat. No. 355,810, granted Jan. 11, 1887 to Edwin L. Brown, and U.S. Pat. No. 1,389,941, granted Sep. 6, 1921 to Reiner W. Erdle, teach sources of photoluminescence suitable for retrofit to existing structures. However, these references do not teach a source of photoluminescence that is amenable to installation in a variety of applications.

Other prior art references, such as U.S. Pat. No. 2,341,583, granted Feb. 15, 1944 to Richard L. Tuve, and U.S. Pat. No. 4,401,050, granted Aug. 30, 1983 to Laurence D. Britt and Richard G. Britt, teach a source of photoluminescence that can be installed almost anywhere. Tuve ('583) and Britt ('050) teach applying photoluminescent pigment to adhesive tape which is then attached to a building structure. These references do not teach a method for attachment to a building structure when an adhesive cannot be used. Materials applied with adhesives can also be difficult to remove should changes to the passive pathway marking system need to be made.

SUMMARY OF THE INVENTION

The present invention combines the objects of providing a source of photoluminescence that can be used in a building structure as a back-up lighting and pathway marking system that by nature of its construction is amenable to installation in a variety of settings, can be installed under a variety of conditions, and is easily replaced and repaired. These objects are achieved by constructing the source of photoluminescence as interlocking components: a base member that can attach to the building structure by a variety of means and a separate support member that carries the photoluminescent material and is releasably attached to the base member.

A further object of the present invention is to provide a back-up lighting system that is attractive and complements the interior design of the building structure when it is not needed as a source of photoluminescence. This object is achieved by forming the support member so that it covers and hides the base member which attaches to the building structure. This object is further achieved by forming the base member of the present invention from a relatively rigid material that can be easily installed along straight lines. This object is also achieved by forming the support member and the photoluminescent material of the present invention of a relatively flexible material that can mold itself to a variety of different members in a building structure as well as irregularities in the members of the building structure.

A further object of the present invention is to form the base member of the present invention so that it can mechanically interlock with the building structure. This object is achieved by forming the base member with an attachment flange.

A further object of the present invention is to provide for easy engagement and disengagement of the support member of the present invention with the base member. This object is achieved by forming the base member with a receiving track, and the support member with an attachment arm that releasably engages said receiving track.

A further object of the present invention is to affix the photoluminescent material of the present invention on the support member so that it charges quickly and so that it is easily viewed.

DESCRIPTION OF THE DRAWINGS

FIG. 13 is a side elevation view of stairway with the present invention attached to the risers of a stairway, to a wall, and to a handrail.

FIG. 14 is a side, sectional view of the present invention taken along line 14—14 of FIG. 13. The present invention is shown attached to a stair riser with a fastener that penetrates the attachment flange of the present invention.

FIG. 15 is a side, sectional view of the present invention taken along line 15—15 of FIG. 13. This alternate form of the present invention has two attachment flanges, and is shown attached to a handrail.

FIG. 16 is a side, sectional view of the present invention taken along line 16—16 of FIGS. 10 and 13. The present invention is shown attached to a wall.

DESCRIPTION OF THE PREFERRED EMBODIMENT OF THE INVENTION

Figure 2:
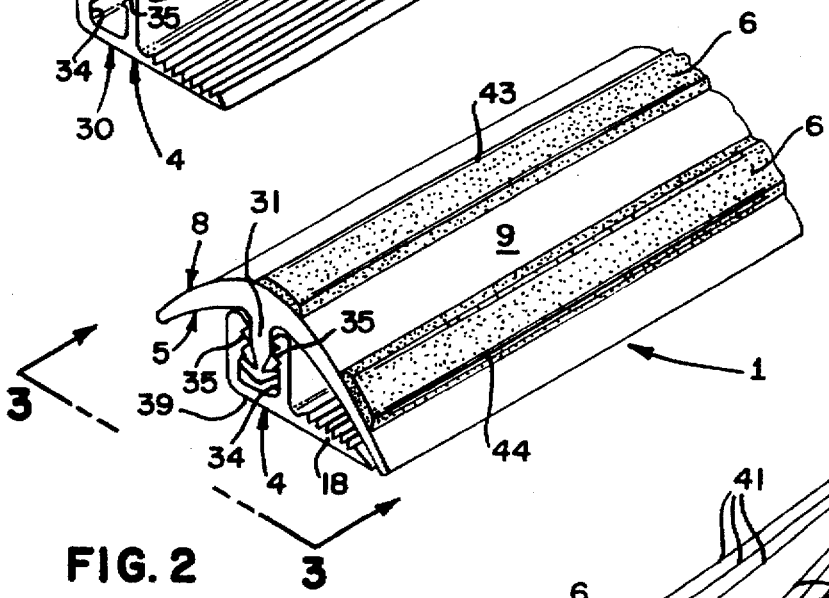
FIG. 2 is a perspective view of the present invention with the support member attached to the base member.

As shown in FIG. 2, a source of photoluminescence 1 for attachment to a building structure 2 to be used as part of a back-up lighting system made according to the present invention includes: a base member 4 which attaches to the building structure 2, a support member 5 which releasably attaches to the base member 4, and photoluminescent material 6 affixed to the support member 5 so as to be visible to an occupant 7 escaping from the building structure 2. The support member 5 is formed with a cover member 8 that in cooperation with the building structure 2 hides the base member 4 from view when the source of photoluminescence 1 is attached to the building structure 2. The photoluminescent material 6 is affixed to the outer surface 9 of the cover member 8.

Figure 9:
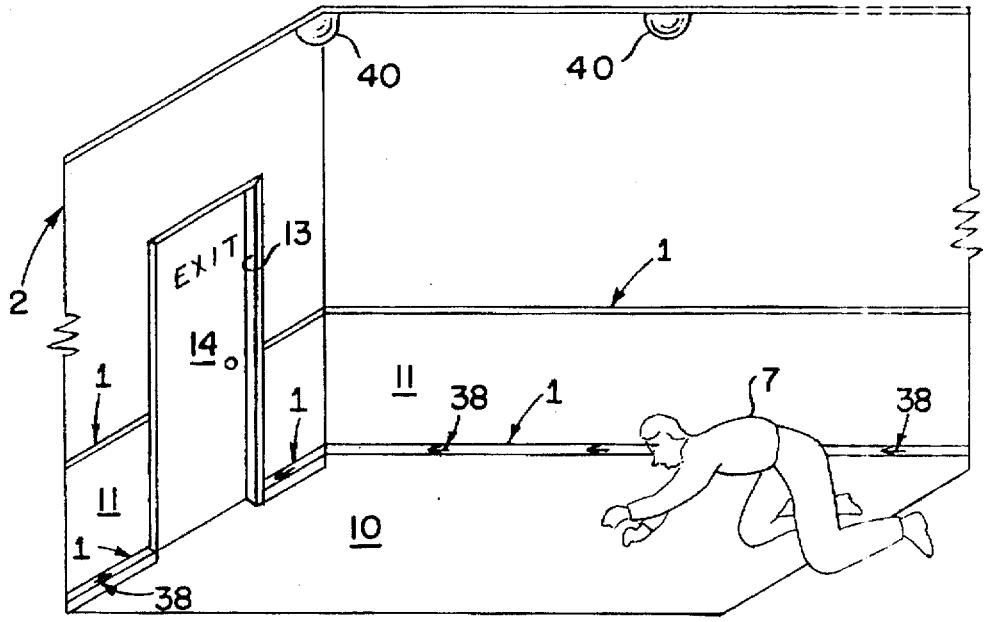
FIG. 9 is a perspective view of a portion of a building structure with the present invention installed near floor level. Portions of the photoluminescent material are shaped as direction indicators which are oriented toward the exit. An occupant is shown crawling on the floor towards the exit.

As is shown in FIG. 9, the source of photoluminescence 1 of the present invention can be installed just above the floor 10 of a building structure 2 to illuminate the interfaces between the wall 11 and the floor 10.

Figure 10:
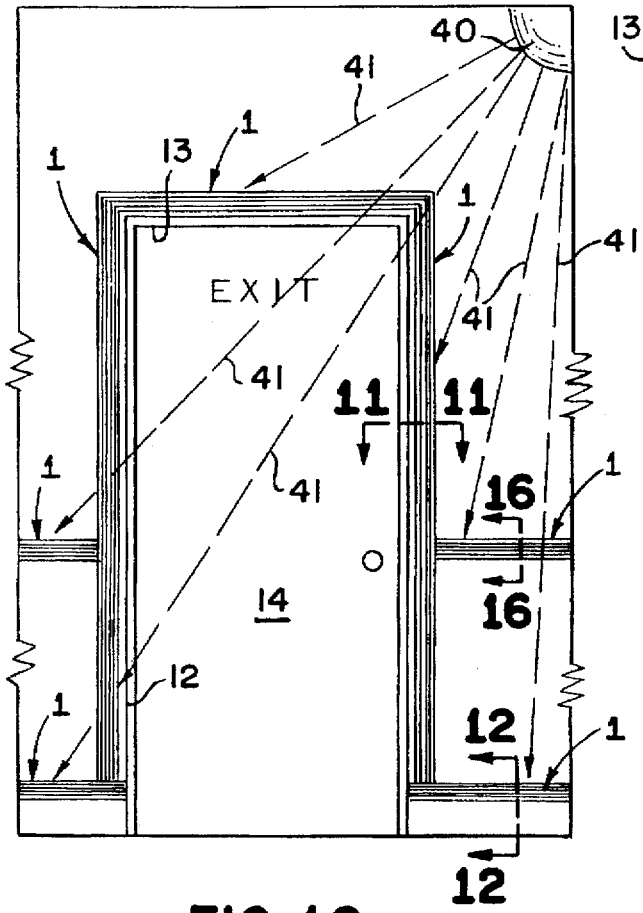
FIG. 10 is front elevation view of a doorway in a building structure with the present invention installed near floor level, higher up on the wall of a building structure, and around a doorway. A light source is shown with rays of light striking the photoluminescent material of the present invention.

As shown in FIG. 10, the source of photoluminescence 1 of the present invention can be installed around the trim 12 of a doorway opening 13 to indicate the presence of a door 14.

As shown in FIGS. 13 and 14, the source of photoluminescence 1 of the present invention can be installed at the interface of a stair tread 15 and a stair riser 16. FIG. 13 also shows the source of photoluminescence 1 of the present invention installed on a handrail 17 and along the wall 11 to provide illumination and suggest that the occupant 7 must ascend or descend.

Figure 12:
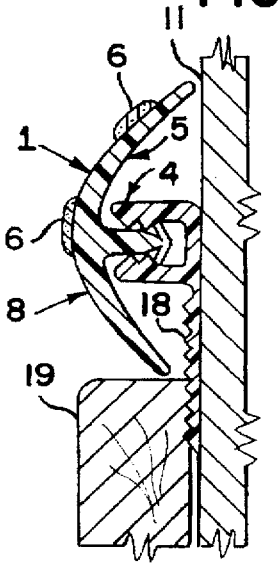
FIG. 12 is a side, sectional view of the present invention taken along line 12—12 of FIG. 10.
Figure 17:
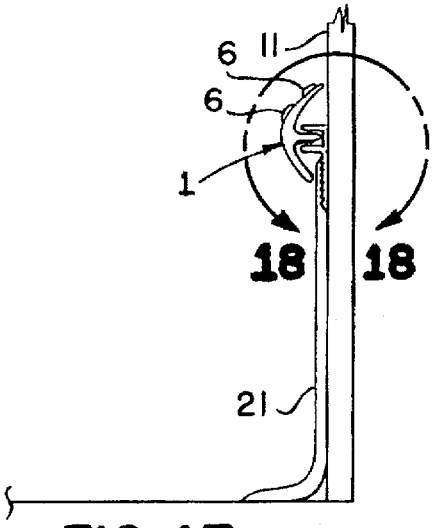
FIG. 17 is a side, sectional view of the present invention attached to a wall at the top of a covebase.
Figure 19:
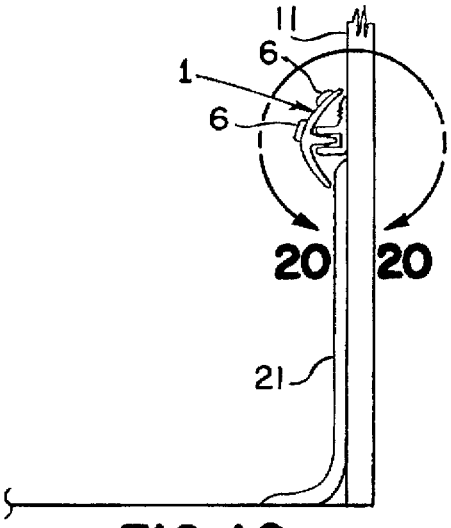
FIG. 19 is a side, sectional view of the present invention attached to a wall at the top of a covebase.

As shown in FIG. 12, in the preferred embodiment, the base member 4 is formed with an attachment flange 18 that can mechanically interlock with the building structure 2. FIG. 12 shows the attachment flange 18 of the base member 4 inserted between the wall 11 and the baseboard 19 of the building structure 2.

Figure 11:
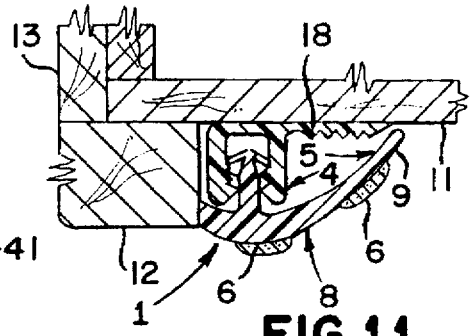
FIG. 11 is top plan, sectional view of the present invention taken along line 11—11 of FIG. 10. The present invention is shown attached to a wall adjacent to a doorway. An alternate form of the support member of the present invention is shown that is truncated.

The attachment flange 18 can be made in various dimensions depending on the application. A longer attachment flange 18 provides better mechanical interlock with the members of a building structure 2 than a shorter attachment flange 18. When the attachment flange 18 will be inserted between the members of a building structure 2, such as is shown in FIG. 12, the attachment flange 18 can extend beyond the cover member 8 of the support member 5 and still be hidden from view. This is because the members of the building structure 2, such as the baseboard 19 shown in FIG. 12, hide the attachment flange 18. As shown in FIG. 11, when the attachment flange 18 will not be inserted between the members of a building structure 2, then the attachment flange 18 must be formed so that it does not extend past the cover member 8 in order for it to remain hidden from view. FIG. 11 shows the source of photoluminescence 1 attached to a wall 11 and abutting the trim member 12 of a doorway opening 13.

FIG. 15 shows the base member 4 formed with two attachment flanges 18. FIG. 15 shows the source of photoluminescence 1 attached to a hand-rail 17 in a building structure 2.

Figure 20:
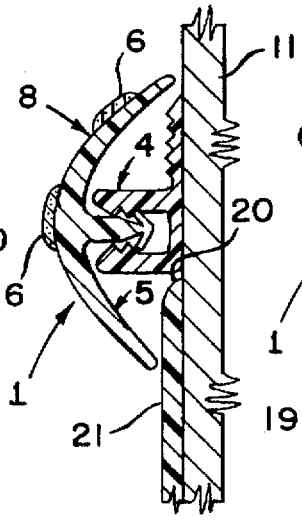
FIG. 20 is an enlarged sectional view of the present invention taken along line 20—20 of FIG. 19. The present invention is shown with a base member with a truncated attachment flange. The attachment flange in this view is not inserted between the wall and the covebase, as would occur when the present invention is installed after the covebase has been installed and there is insufficient space to insert the attachment flange between the cove base and the wall.
Figure 22:
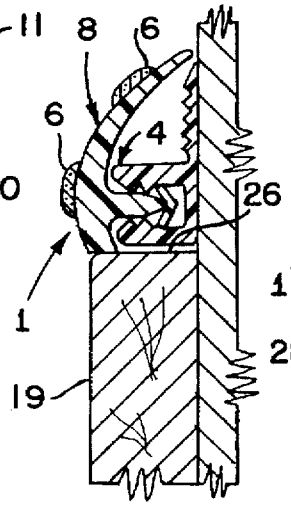
FIG. 22 is an enlarged sectional view of the present invention taken along line 22—22 of FIG. 21. The present invention is shown with a base member with a truncated attachment flange and with a support member with a truncated cover member.
Figure 26:
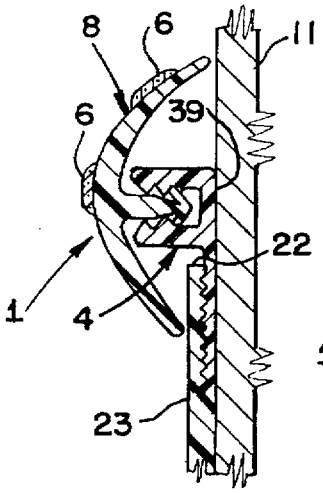
FIG. 26 is an enlarged sectional view of the present invention taken along line 26—26 of FIG. 25. The attachment flange is shown inserted between the wall and the vinyl flooring.
Figure 28:
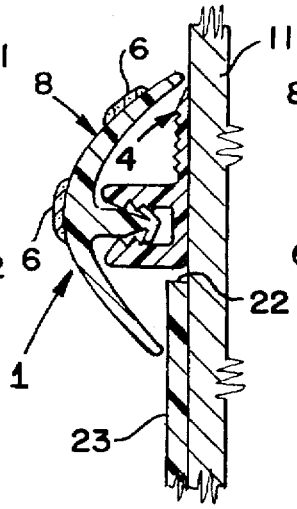
FIG. 28 is an enlarged sectional view of the present invention taken along line 28—28 of FIG. 27. The present invention is shown with a base member with a truncated attachment flange.
Figure 30:
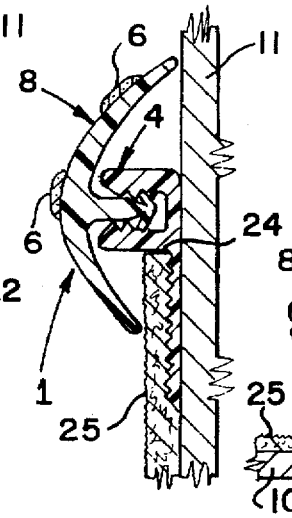
FIG. 30 is an enlarged sectional view of the present invention taken along line 30—30 of FIG. 29. The attachment flange is shown inserted between the wall and the coved carpet.
Figure 32:
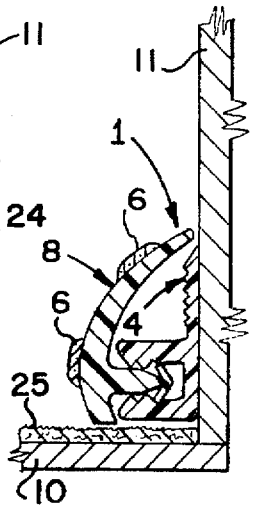
FIG. 32 is an enlarged sectional view of the present invention taken along line 32—32 of FIG. 31. The present invention is shown with a base member with a truncated attachment flange and with a support member with a truncated cover member.
Figure 29:
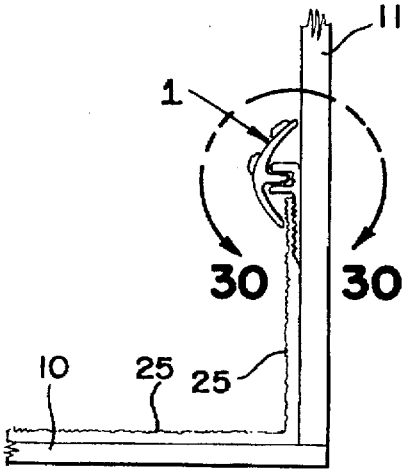
FIG. 29 is a side, sectional view of the present invention attached to a wall at the top of a coved carpet.
Figure 31:
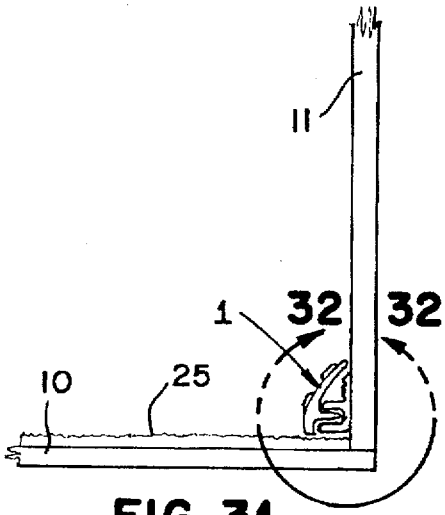
FIG. 31 is a side, sectional view of the present invention attached to a wall adjacent a carpeted floor.

As is shown best in FIGS. 20 and 22, the cover member 8 can be made in various dimensions depending on the application. In FIG. 20, the source of photoluminescence 1 is installed at the upper edge 20 of a relatively thin covebase 21. In this instance the cover member 8 is formed as a curved member that obscures view of the base member 4 from approximately 180 degrees. In FIG. 26, the source of photoluminescence 1 is installed at the upper edge 22 of a relatively thin sheet of vinyl flooring 23. Here too, the cover member 8 is formed so that it obscures view of the base member 4 from approximately 180 degrees. In FIG. 30, the source of photoluminescence 1 is installed at the upper edge 24 of carpet 25 that is coved. Again, the cover member 8 is formed so that it obscures view of the base member 4 from approximately 180 degrees.

Figure 24:
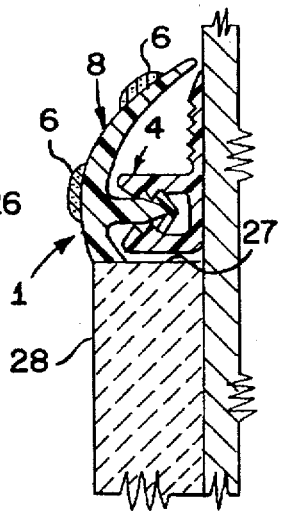
FIG. 24 is an enlarged sectional view of the present invention taken along line 24—24 of FIG. 23. The present invention is shown with a base member with a truncated attachment flange and with a support member with a truncated cover member.
Figure 21:
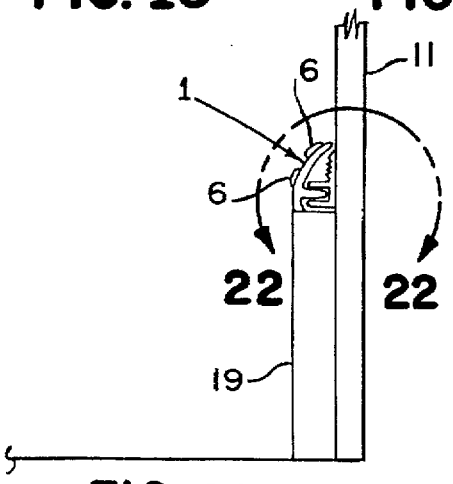
FIG. 21 is a side, sectional view of the present invention attached to a wall at the top of a baseboard.
Figure 23:
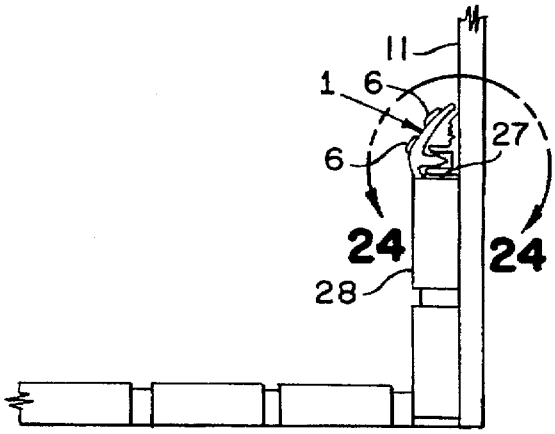
FIG. 23 is a side, sectional view of the present invention attached to a wall at the top of a ceramic tile member.
Figure 25:
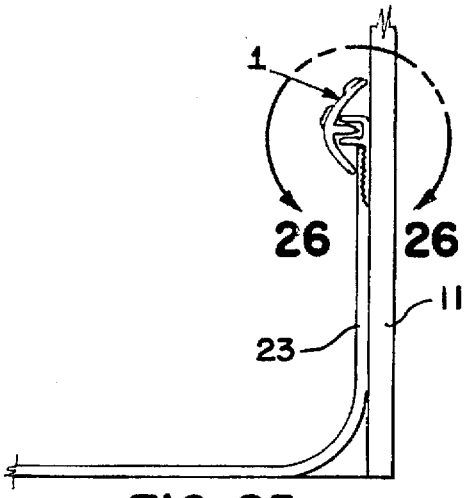
FIG. 25 is a side, sectional view of the present invention attached to a wall at the top of a sheet vinyl flooring that is coved.
Figure 27:
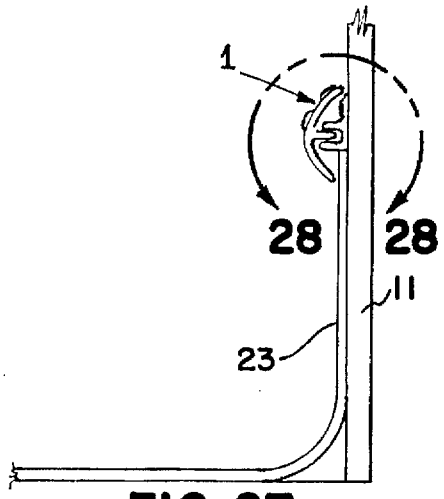
FIG. 27 is a side, sectional view of the present invention attached to a wall at the top of a sheet vinyl flooring that is coved.

In FIG. 22, the source of photoluminescence 1 is installed at the upper edge 26 of a relatively wide baseboard 19. In this instance the cover member 8 need only be formed so as to prevent view of the base member 4 from 90 degrees. The baseboard 19 hides the base member 4 from sight from below. FIG. 24 shows the source of photoluminescence 1 installed at the upper edge 27 of a relatively wide tile member 28. Here, too, the cover member 8 need only be formed to prevent view of the base member 4 from 90 degrees.

As shown in FIG. 14, forming the base member 4 with an attachment flange 18 also provides for easy attachment to the building structure 2 by a fastener 29. FIG. 14 shows a fastener 29 driven through the attachment flange 18 and into the stair riser 16 of a building structure 2. Other forms and means of permanent attachment with fasteners 29 may occur to those skilled in the art.

Forming the base member 4 with an attachment flange 18 also provides a relatively large surface area for the placement of adhesives or double-sided tape that can be used instead of, or in combination with, fasteners 29 to attach the base member 4 to the building structure 2.

Figure 1:
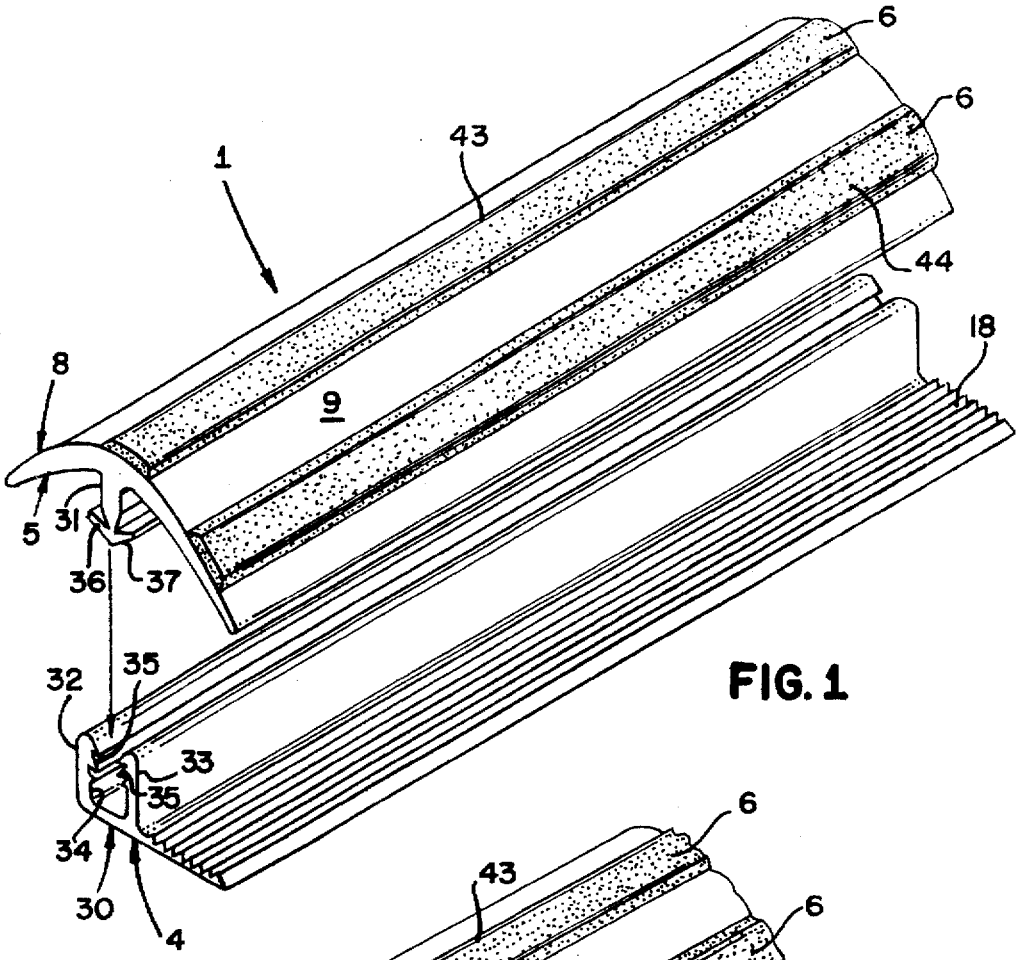
FIG. 1 is a perspective view of the present invention with the support member detached from the base member.

As is shown best in FIGS. 1 and 2, in the preferred embodiment, releasable mechanical coupling of the support member 5 with the base member 4 is achieved by forming the base member 4 with a receiving track 30 and the support member 5 with an attachment arm 31. The receiving track 30 consists of a pair of cooperating legs 32 and 33 which form a cavity 34. Each of the cooperating legs 32 and 33 is formed with one or more teeth 35 that jut into the cavity 34. The attachment arm 31 of the support member 5 is dimensioned for receipt between the cooperating legs 32 and 33 of the receiving track 30. The attachment arm 31 is formed with cooperating outwardly disposed tabs 36 and 37 that mechanically interlock with the teeth 35 of the cooperating legs 32 and 33 of the receiving track 30 when the attachment arm 31 is received by the receiving track 30.

Figure 8:
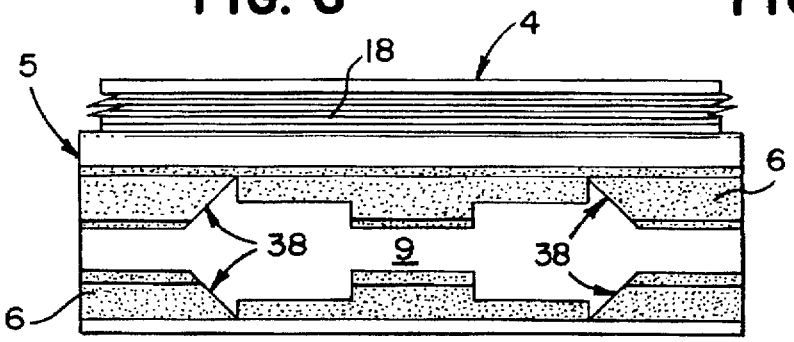
FIG. 8 is a top plan view of the present invention with the photoluminescent material affixed to the support member in a manner that creates direction indicators pointing in opposite directions.

Releasable attachment of the support member 5 to the base member 4 allows a safety designer to easily add, change or move direction indicators 38 such as those shown in FIGS. 4, 6, 7 and 8, as the layout of the building structure 2 changes. FIG. 8 shows the photoluminescent material 6 designed in the shape of direction indicators 38 pointing in opposite directions to indicate that an exit is equally close in either direction. FIG. 9 shows an escaping occupant 7 crawling along the floor 10 of a building structure 2 with direction indicators 38 formed in the photoluminescent material 6 pointing towards the exit.

Releasable attachment of the support member 5 to the base member 4 also allows a safety designer to replace support members 5 when they become damaged. In situations where tampering or vandalism could be a problem, a bonding cement, contact adhesive or epoxide can be placed in the cavity 34 of the receiving track 30, bonding the attachment arm 31 and the receiving track 30 together for a more permanent connection.

In the preferred embodiment, the support member 5 and the photoluminescent material 6 are formed so that they are relatively flexible, while the base member 4 is formed so that it rather inflexible or rigid. Forming the support member 5 and photoluminescent material 6 to be relatively flexible allows the support member 5 to mold itself to irregularities in the building structure 2. Forming the support member 5 and photoluminescent material 6 to be flexible also allows the support member 5 to mold itself to building structures of various dimensions.

Forming the base member 4 to be relatively rigid makes it very easy to install the base member 4 along a straight line, providing a neater finished appearance.

Both the support member 5 and base member 4 can be manufactured by an extrusion or molding process from rubber, vinyl, or metal to name a few suitable materials. Selection of material is limited by expected life, cost and suitability for use as interior building products.

Figure 3:
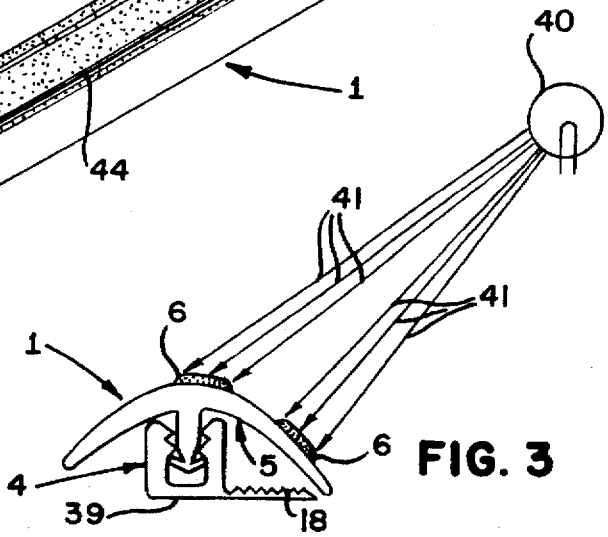
FIG. 3 is a side elevation view of the present invention taken along line 3—3 of FIG. 2. A light source is shown with rays of light striking the photoluminescent material of the present invention.
Figure 4:
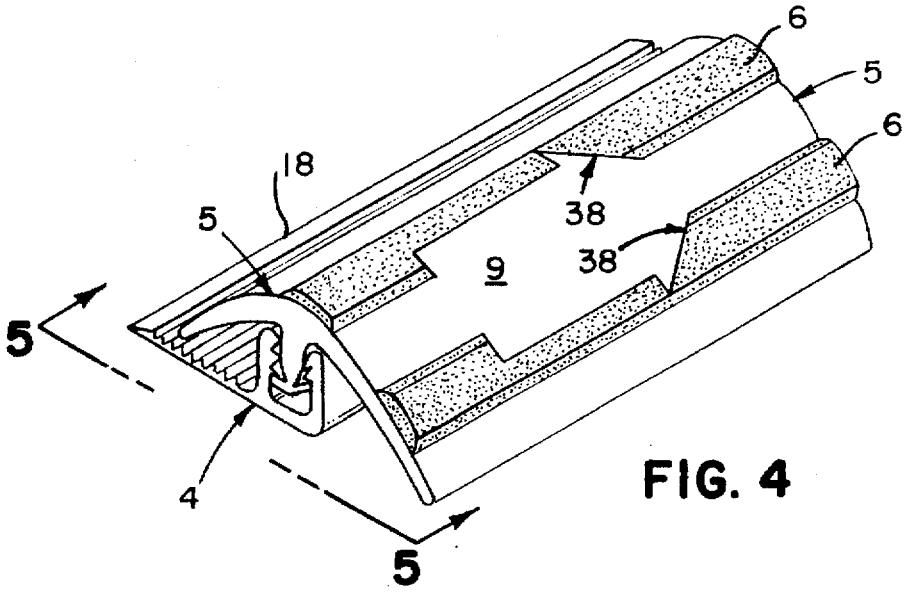
FIG. 4 is a perspective view of the present invention with the photoluminescent material affixed to the support member in a manner that creates a direction indicator.
Figure 5:
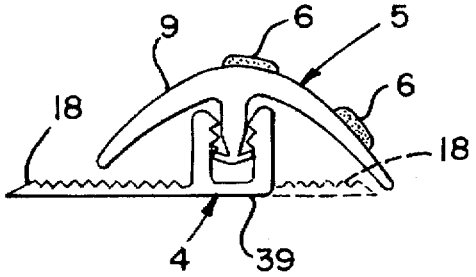
FIG. 5 is a side elevation view of the present invention taken along line 5—5 of FIG. 4. Dotted lines show an alternate form of the attachment flange of the base member, oriented in the opposite direction. The alternate form of the attachment flange is truncated so that it is hidden by the support member.
Figure 6:
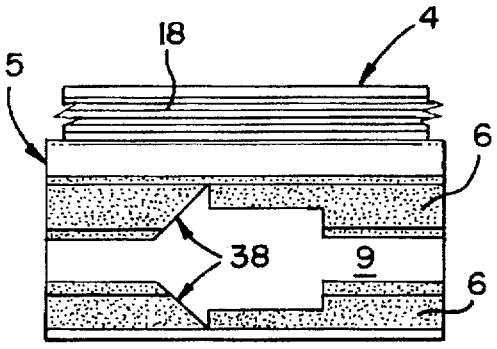
FIG. 6 is a top plan view of the present invention with the photoluminescent material affixed to the support member in a manner that creates a direction indicator.
Figure 7:
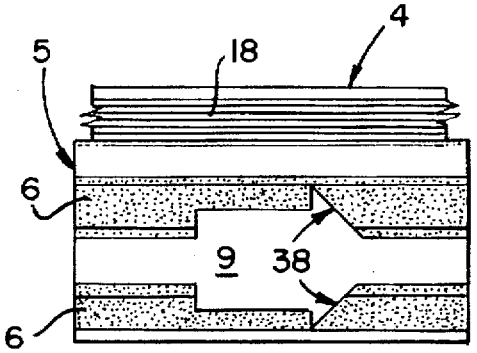
FIG. 7 is a top plan view of the present invention with the photoluminescent material affixed to the support member in a manner that creates a direction indicator.

The photoluminescent material 6 is made from a suitable vinyl, rubber or plastic compound containing photoluminescent pigments which are generally crystalline zinc sulfide. Crystalline zinc sulfide and other similar photoluminescent pigments are capable of storing light energy and emitting a glow for several hours after the light source 40 is removed. FIGS. 3 and 10 show rays of light 41 from a light source 40 charging the source of photoluminescence 1 of the present invention.

When the photoluminescent material 6 is made from vinyl, the inventors have found that a photoluminescent pigment such as crystalline zinc sulfide must be present in the photoluminescent material at 10% to 50% of the photoluminescent material by weight to provide adequate illumination of sufficient duration. The inventors have found that when sufficient photoluminescent pigment is present, exposure for five minutes to a light source 40 can charge the photoluminescent material 6 sufficiently to be visible to the human eye for several hours after removal of the light source 40.

Crystalline zinc sulfide and other photoluminescent pigments charge more slowly with each additional unit of time. After a threshold time has passed, generally about 30 minutes, additional exposure to light contributes little to the photoluminescent charge.

Crystalline zinc sulfide is luminescent, but not translucent, so light penetrates and charges the photoluminescent material 6 only so far. By laying the photoluminescent material 6 on top of the support member 5, rays of light from the side can also be received and aid in charging the photoluminescent material 6.

Typical vinyl compounds found to be suitable for manufacture of the photoluminescent material 6, the support member 5 and the base member 4 are shown below, with numbers representing parts by weight:

| | Luminescent member | Cover Member | Base member |
|---|---|---|---|
| PVC Resin | 100 | 100 | 100 |
| Heat Stabilizer | 3–5 | 3–5 | 3–5 |
| U.V. Stabilizer | 0–2 | 0–2 | 0–2 |
| Antioxidant | 0–2 | 0–2 | 0–2 |
| Liquid or Solid Plasticizer | 10–30 | 10–30 | 0–10 |
| Photoluminescent Pigment | 40–80 | | |
| Color pigments | | 0–15 | 0–15 |
| Process Acids | 0–5 | 0–5 | 0–5 |
| Fillers/Extender | 0 | 20–80 | 0–30 |

Figure 18:
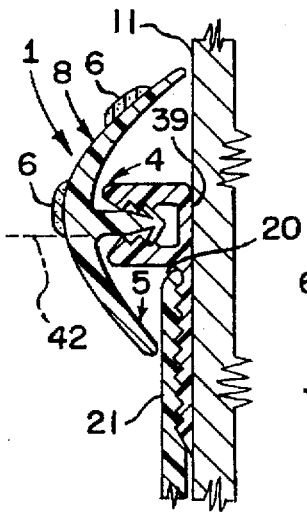
FIG. 18 is an enlarged sectional view of the present invention taken along line 18—18 of FIG. 17. The attachment flange is shown inserted between the wall and the covebase.

As is shown best in FIG. 18, in the preferred embodiment the base member 4 is formed with a planar surface 39 for attachment of the base member 4 to the building structure 2. Further, the photoluminescent material 6 is affixed to the outer surface 9 of the cover member 8 to one side of a line 42 lying normal to the planar surface 39 of the base member 4 and intersecting with the outer surface 9 of the cover member 8 where the outer surface 9 is disposed substantially farthest from the planar surface 39 of the base member 4. Also in the preferred embodiment, the photoluminescent material 6 is affixed to the outer surface 9 of the cover member 8 where the outer surface 9 of the cover member 8 lies askew to the planar surface 39 of the base member 4. Affixing the photoluminescent material 6 in this manner results in the photoluminescent material 6 being disposed at angle or askew to the wall 11 or other building structure 2 to which it is attached.

Ideally, the source of photoluminescence 1 is attached to the building structure 2 with the photoluminescent material 6 directed away from the building structure 2 to which it is attached or to which it sits adjacent: that is to say, the photoluminescent material 6 is positioned so that an occupant 7 escaping the building structure 2 has an unobstructed view of the photoluminescent material 6. See FIG. 9.

Placement of the photoluminescent material 6 according to the preferred embodiment together with the attachment of the source of photoluminescence 1 in the ideal manner results in the best conditions both for charging the photoluminescent material 6 and for viewing it. Generally, commercial building structures 2 are designed with light sources 40 placed so that their light is directed toward the center of the room. The preferred embodiment angles the photoluminescent material 6 with respect to the wall 11 so that it faces towards the ceiling and the center of the room where it can best receive charging light rays 41 from the light sources 40.

The photoluminescent material 6 can also be placed on the cover member 8 in any design desired. The inventors prefer forming the photoluminescent material 6 on the support member 5 in two stripes 43 and 44 that run the length of the support member 5. See FIG. 1. In the dark, the two stripes 43 and 44 make the photoluminescent material 6 more recognizable as a designated safety device rather than mere decoration. The photoluminescent material 6 can also be formed to create direction indicators 38, as is shown in FIGS. 4, 6, 7 and 8.

The support member 5 and the base member 4 can be formed in whatever lengths are most suitable. The inventors have found that 8 foot lengths are a useful dimension for modular construction for both the base member 4 and the support member 5. Support members 5, having photoluminescent material 6 formed in the shape of direction indicators 38, such as are shown in FIGS. 4, 6, 7 and 8, can be formed in shorter lengths. Sections of support member 5 having direction indicators 38 can be inserted into the receiving track 30 of the base member 4 wherever the safety designer feels it is appropriate.

The invention is not limited to the specific form shown, but includes all forms within the definitions of the following claims.

We claim:

1. A source of photoluminescence for attachment to a building structure to be used as part of a back-up lighting system, said source of photoluminescence comprising:

a) a base member which attaches to said building structure;

b) a support member releasably attached to said base member, said support member being formed with a cover member that in cooperation with said building structure hides said base member from view when said source of photoluminescence is attached to said building structure, said cover member being formed with an outer surface; and c) photoluminescent material affixed to said outer surface of said cover member.

2. The source of photoluminescence of claim 1 wherein:

said base member is formed with an attachment flange that can be used for mechanical interlock with said building structure.

3. The source of photoluminescence of claim 1 wherein:

a) said base member is formed with a receiving track, said receiving track consisting of a pair of cooperating legs which form a cavity, each of said cooperating legs being formed with a tooth that juts into said cavity; and b) said support member is formed with an attachment arm which is dimensioned for receipt between said cooperating legs of said receiving track, said attachment arm being formed with cooperating outwardly disposed tabs that mechanically interlock with said teeth of said cooperating legs of said receiving track when said attachment arm is received by said receiving track.

4. The source of photoluminescence of claim 3 wherein:

said base member is formed with an attachment flange that can be used for mechanical interlock with said building structure.

5. The source of photoluminescence of claim 1, wherein:

a) said support member and said photoluminescent material are made from relatively flexible material; and b) said base member is made from relatively inflexible material.

6. The source of photoluminescence of claim 5 wherein:

a) said base member is formed with a receiving track, said receiving track consisting of a pair of cooperating legs which form a cavity, each of said cooperating legs being formed with a tooth that juts into said cavity; and b) said support member is formed with an attachment arm which is dimensioned for receipt between said cooperating legs of said receiving track, said attachment arm being formed with cooperating outwardly disposed tabs that mechanically interlock with said teeth of said cooperating legs of said receiving track when said attachment arm is received by said receiving track.

7. The source of photoluminescence of claim 5 wherein:

said base member is formed with an attachment flange that can be used for mechanical interlock with said building structure.

8. The source of photoluminescence of claim 6 wherein:

said base member is formed with an attachment flange that can be used for mechanical interlock with said building structure.

9. The source of photoluminescence of all preceding claims wherein:

a) said base member is formed with a planar surface for attachment of said base member to said building structure; and b) said photoluminescent material is affixed to said outer surface of said cover member to one side of a line lying normal to said planar surface of said base member and intersecting with said outer surface of said cover member where said outer surface is disposed substantially farthest from said planar surface of said base member, said photoluminescent material also being affixed to said outer surface of said cover member where said outer surface of said cover member lies askew to said planar surface of said base member.

10. A source of photoluminescence for attachment to a building structure to be used as part of a back-up lighting system, said source of photoluminescence comprising:

a) a base member made of relatively inflexible material which attaches to said building structure, said base member being formed with an attachment flange that can be used for mechanical interlock with said building structure and said base member also being formed with a receiving track, said receiving track consisting of a pair of cooperating legs which form a cavity, each of said cooperating legs being formed with a tooth that juts into said cavity;

b) a support member made of relatively flexible material releasably attached to said base member, said support member being formed with a cover member that in cooperation with said building structure hides said base member from view when said source of photoluminescence is attached to said building structure, said cover member also being formed with an outer surface; said support member also being formed with an attachment arm for releasably attaching said support member to said base member, said attachment arm being dimensioned for receipt between said cooperating legs of said receiving track, said attachment arm being formed with cooperating outwardly disposed tabs that mechanically interlock with said teeth of said cooperating legs of said receiving track when said attachment arm is received by said receiving track; and c) photoluminescent material made of relatively flexible material affixed to said outer surface of said cover member.

11. The source of photoluminescence of claim 10 wherein:

a) said base member is formed with a planar surface for attachment of said base member to said building structure; and b) said photoluminescent material is affixed to said outer surface of said cover member to one side of a line lying normal to said planar surface of said base member and intersecting with said outer surface of said cover member where said outer surface is disposed substantially farthest from said planar surface of said base member, said photoluminescent material also being affixed to said outer surface of said cover member where said outer surface of said cover member lies askew to said planar surface of said base member.

* * * * *